US010535240B2

(12) United States Patent
Fawcett et al.

(10) Patent No.: US 10,535,240 B2
(45) **Date of Patent: *Jan. 14, 2020**

(54) MERCHANDISE SECURITY SYSTEM WITH OPTICAL COMMUNICATION

(71) Applicant: InVue Security Products Inc., Charlotte, NC (US)

(72) Inventors: Christopher J. Fawcett, Charlotte, NC (US); Gary A. Taylor, Fort Mill, SC (US); Kevin A. Burtness, Charlotte, NC (US)

(73) Assignee: InVue Security Products Inc., Charlotte, NC (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/553,979

(22) Filed: Aug. 28, 2019

(65) Prior Publication Data

US 2019/0385426 A1 Dec. 19, 2019

Related U.S. Application Data

(63) Continuation of application No. 16/354,400, filed on Mar. 15, 2019, now Pat. No. 10,403,106, which is a (Continued)

(51) Int. Cl.
*G08B 13/12* (2006.01)
*G08B 13/14* (2006.01)

(52) U.S. Cl.
CPC ..... *G08B 13/1481* (2013.01); *G08B 13/1463* (2013.01); *G08B 13/149* (2013.01)

(58) Field of Classification Search
CPC ..... G08B 13/1463; G08B 13/126; G08B 13/1409; G08B 13/1481; G08B 13/149; (Continued)

(56) References Cited

U.S. PATENT DOCUMENTS 5,003,292 A 3/1991 Harding et al.
5,055,827 A 10/1991 Phillip
(Continued)

FOREIGN PATENT DOCUMENTS

CA 2647904 A1 10/2007
DE 102009049738 A1 4/2011
(Continued)

OTHER PUBLICATIONS

International Appl. No. PCT/US16/34026, International Search Report and Written Opinion, dated Aug. 23, 2016, 8 pages.
(Continued)

*Primary Examiner* — Daniel Previl
(74) *Attorney, Agent, or Firm* — InVue Security Products Inc.

(57) ABSTRACT

Embodiments of the present invention are directed to security systems and methods for securing an item of merchandise from theft or unauthorized removal. For example, the security system may include a sensor configured to be coupled to the item of merchandise and a charging circuit for providing power to the sensor and/or the item of merchandise. The security system may also include a cable connected to the sensor and at least one optical transceiver for defining a sense loop between the cable and the sensor.

51 Claims, 13 Drawing Sheets

Related U.S. Application Data continuation of application No. 16/109,145, filed on Aug. 22, 2018, now Pat. No. 10,373,457, which is a continuation of application No. 15/723,744, filed on Oct. 3, 2017, now Pat. No. 10,062,253, which is a continuation of application No. 15/163,846, filed on May 25, 2016, now Pat. No. 9,818,274.

(60) Provisional application No. 62/167,382, filed on May 28, 2015, provisional application No. 62/257,380, filed on Nov. 19, 2015, provisional application No. 62/260,693, filed on Nov. 30, 2015.

(58) Field of Classification Search

CPC ..... G08B 3/10; A47F 7/024; B65H 75/265; B65H 75/48; E05B 73/0082; G06Q 20/10; G06Q 20/18; G06Q 20/342; G06Q 30/02; G06Q 30/0215; G06Q 30/0641; G06Q 50/01; G07F 17/329; H04W 4/14

USPC ..... 340/568.2, 5.61, 5.65, 568.1, 568.8, 340/568.5, 552, 572.1–572.9, 674, 673, 340/691.6, 5.91

See application file for complete search history.

(56) References Cited

U.S. PATENT DOCUMENTS

| | | | | |
|---|---|---|---|---|
| 5,912,619 | A | 6/1999 | Vogt | |
| 6,050,622 | A | 4/2000 | Gustafson | |
| 6,150,940 | A | 11/2000 | Chapman et al. | |
| 6,169,295 | B1 | 1/2001 | Koo | |
| 6,648,520 | B2 | 11/2003 | McDonald et al. | |
| 6,799,994 | B2 | 10/2004 | Burke | |
| 6,804,465 | B2 | 10/2004 | Volpi et al. | |
| 6,888,461 | B2 | 5/2005 | Houde | |
| 7,209,038 | B1 | 4/2007 | Deconinck et al. | |
| 7,239,238 | B2 | 7/2007 | Tester et al. | |
| 7,327,276 | B1 | 2/2008 | Deconinck et al. | |
| 7,667,601 | B2 | 2/2010 | Rabinowitz et al. | |
| 8,368,536 | B2 | 2/2013 | Fawcett et al. | |
| 8,558,688 | B2 | 10/2013 | Henson et al. | |
| 8,579,659 | B2 | 11/2013 | Tran et al. | |
| 8,696,377 | B2 | 4/2014 | Kelsch et al. | |
| 8,698,617 | B2 | 4/2014 | Henson et al. | |
| 8,698,618 | B2 | 4/2014 | Henson et al. | |
| 8,909,008 | B1 | 12/2014 | Tzeng et al. | |
| 9,443,404 | B2 | 9/2016 | Grant et al. | |
| 9,747,765 | B1 | 9/2017 | Berglund et al. | |
| 9,761,101 | B2 | 9/2017 | Berglund et al. | |
| 9,805,564 | B1 | 10/2017 | Berglund et al. | |
| 9,818,274 | B2 * | 11/2017 | Fawcett | G08B 13/1481 |
| 9,928,704 | B2 | 3/2018 | Berglund et al. | |
| 9,972,178 | B2 | 5/2018 | Richardson et al. | |
| 10,008,082 | B2 | 6/2018 | Burmeister, II | |
| 10,043,358 | B1 | 8/2018 | Berglund et al. | |
| 10,062,253 | B2 * | 8/2018 | Fawcett | G08B 13/1481 |
| 10,098,481 | B2 | 10/2018 | Berglund et al. | |
| 10,373,457 | B2 * | 8/2019 | Fawcett | G08B 13/1463 |
| 10,403,106 | B2 * | 9/2019 | Fawcett | G08B 13/1463 |
| 2002/0047867 | A1 | 4/2002 | Mault et al. | |
| 2006/0049587 | A1 | 3/2006 | Cornwell | |
| 2008/0306436 | A1 | 12/2008 | Edwards et al. | |
| 2010/0141424 | A1 | 6/2010 | Calahorra et al. | |
| 2010/0215320 | A1 | 8/2010 | Staeber et al. | |
| 2011/0013905 | A1 | 1/2011 | Wang et al. | |
| 2011/0066051 | A1 | 3/2011 | Moon et al. | |
| 2011/0208015 | A1 | 8/2011 | Welch et al. | |
| 2011/0241870 | A1 | 10/2011 | Irmscher et al. | |
| 2011/0254661 | A1 | 10/2011 | Fawcett et al. | |
| 2011/0309928 | A1 | 12/2011 | Henson et al. | |
| 2011/0309934 | A1 | 12/2011 | Henson et al. | |
| 2012/0047972 | A1 * | 3/2012 | Grant | A47F 3/002 70/77 |
| 2012/0099256 | A1 | 4/2012 | Fawcett et al. | |
| 2012/0144885 | A1 | 6/2012 | Mills | |
| 2012/0257890 | A1 | 10/2012 | Aguren | |
| 2012/0268103 | A1 | 10/2012 | Henson et al. | |
| 2013/0196530 | A1 * | 8/2013 | Cheatham | H01R 13/62 439/357 |
| 2013/0307668 | A1 * | 11/2013 | Grant | G07C 9/00857 340/5.25 |
| 2014/0111337 | A1 | 4/2014 | Taylor et al. | |
| 2014/0159898 | A1 | 6/2014 | Wheeler et al. | |
| 2014/0334778 | A1 | 11/2014 | Walker et al. | |
| 2015/0013398 | A1 | 1/2015 | Taylor et al. | |
| 2015/0048945 | A1 | 2/2015 | Fawcett et al. | |
| 2016/0087726 | A1 | 3/2016 | Roberds et al. | |
| 2016/0222699 | A1 | 8/2016 | Grant et al. | |
| 2016/0307417 | A1 | 10/2016 | Van Landingham, Jr. et al. | |
| 2016/0351029 | A1 | 12/2016 | Fawcett et al. | |
| 2016/0379455 | A1 | 12/2016 | Grant et al. | |
| 2017/0032636 | A1 | 2/2017 | Henson et al. | |
| 2018/0025598 | A1 | 1/2018 | Fawcett et al. | |
| 2018/0365949 | A1 | 12/2018 | Fawcett et al. | |

FOREIGN PATENT DOCUMENTS

| | | | |
|---|---|---|---|
| EP | 2093727 | A1 | 8/2009 |
| WO | 2002073561 | A1 | 9/2002 |
| WO | 2006116664 | A1 | 11/2006 |
| WO | 2009103793 | A1 | 8/2009 |
| WO | 2011045058 | A2 | 4/2011 |
| WO | 2012069816 | A1 | 5/2012 |

OTHER PUBLICATIONS

Office Action from corresponding Canadian Patent Application No. 2,974,546, dated Jan. 2, 2018 (4 pages).

Office Action from corresponding Canadian Patent Application No. 2,974,546, dated Apr. 16, 2018 (4 pages).

Office Action from corresponding Canadian Patent Application No. 2,974,546, dated Jul. 12, 2018 (4 pages).

Office Action from corresponding Canadian Patent Application No. 2,974,546 dated Feb. 4, 2019 (4 pages).

Partial Supplementary Search Report from corresponding European Patent Application No. 16800653.4, dated Oct. 26, 2018 (14 pages).

Defendant's Preliminary Invalidity Contentions, *InVue Security Products Inc.* v. *Vanguard Products Group, Inc., d/b/a Vanguard Protex Global*, Civil Case No. 8:18-cv-02548-VMC-SPF, (M.D. Fla. 2019) (29 pages).

Exhibit A—Invalidity Claim Charts of the '274 Patent, *InVue Security Products Inc.* v. *Vanguard Products Group, Inc., d/b/a Vanguard Protex Global*, Civil Case No. 8:18-cv-02548-VMC-SPF, (M.D. Fla. 2019) (48 pages).

Exhibit B—Invalidity Claim Charts of the '253 Patent, *InVue Security Products Inc.* v. *Vanguard Products Group, Inc., d/b/a Vanguard Protex Global*, Civil Case No. 8:18-cv-02548-VMC-SPF, (M.D. Fla. 2019) (23 pages).

Petition for Inter Partes Review of U.S. Pat. No. 9,818,274, filed on Jun. 17, 2019 (87 pages).

Petition for Inter Partes Review of U.S. Pat. No. 10,062,253, filed on Jun. 17, 2019 (77 pages).

Weik, Martin H. Excerpts, "Communications Standard Dictionary, Third Edition." Chapman & Hall, 1996.

Office Action from corresponding European Patent Application No. 16800653.4, dated Jul. 22, 2019 (8 pages).

Office Action from corresponding Canadian Patent Application No. 2,974,546 dated Jun. 27, 2019 (6 pages).

* cited by examiner

MERCHANDISE SECURITY SYSTEM WITH OPTICAL COMMUNICATION

CROSS REFERENCE TO RELATED APPLICATIONS

This application is a continuation of U.S. patent application Ser. No. 16/354,400, filed on Mar. 15, 2019, which is a continuation of U.S. patent application Ser. No. 16/109,145, filed on Aug. 22, 2018, and now U.S. Pat. No. 10,373,457 which is a continuation of U.S. patent application Ser. No. 15/723,744, filed on Oct. 3, 2017, and now U.S. Pat. No. 10,062,253, which is a continuation of U.S. patent application Ser. No. 15/163,846, filed on May 25, 2016, and now U.S. Pat. No. 9,818,274, which claims the benefit to priority of U.S. Provisional Patent Application No. 62/167,382 filed on May 28, 2015, U.S. Provisional Patent Application No. 62/257,380 filed on Nov. 19, 2015, and U.S. Provisional Patent Application No. 62/260,693 filed on Nov. 30, 2015, the entire disclosures of which are incorporated herein by reference.

BACKGROUND OF THE INVENTION

Embodiments of the present invention relate generally to security systems for protecting items of merchandise, such as consumer electronics products.

It is common practice for retailers to provide demonstration models of consumer electronics products, such as handheld devices, tablets, and laptop computers, so that a potential purchaser may examine the product more closely and test the operation of its features. A working demonstration model, however, increases the possibility that the demonstration model will be stolen or removed from the display area by an unauthorized person. As a result, demonstration models of consumer electronics products are typically protected by a security system that permits a potential purchaser to examine and operate the product, while reducing the likelihood that the demonstration model will be stolen or removed from the display area.

The security system displays an item of merchandise so that a potential purchaser can readily view and, in some instances, operate the item when making a decision whether to purchase the item. At the same time, the item of merchandise is usually physically secured on the security system so as to prevent, or at least deter, theft of the item. The merchandise display security system may also include an alarm that is activated to alert store personnel in the event that a shoplifter attempts to separate the item of merchandise from the security system.

BRIEF SUMMARY

Embodiments of the present invention are directed to security systems and methods for securing an item of merchandise from theft or unauthorized removal. In one embodiment, a security system includes a sensor configured to be coupled to the item of merchandise and a charging circuit for providing power to the sensor and/or the item of merchandise. The security system also includes a cable configured to be connected to the sensor and at least one optical transceiver for defining a sense loop between the cable and the sensor.

In another embodiment, a security system includes a sensor configured to be coupled to the item of merchandise, wherein the sensor includes an optical transceiver configured to transmit and receive data. The security system also includes a cable configured to be connected to the sensor, wherein the cable includes an optical transceiver configured to transmit and receive data. The optical transceivers are configured to communicate with one another for defining a sense loop between the cable and the sensor.

In one embodiment, a method includes coupling a sensor to an item of merchandise and connecting a cable to the sensor. The cable and/or the sensor includes at least one optical transceiver for defining a sense loop between the cable and the sensor.

DETAILED DESCRIPTION OF EMBODIMENTS OF THE INVENTION

Figure 1:
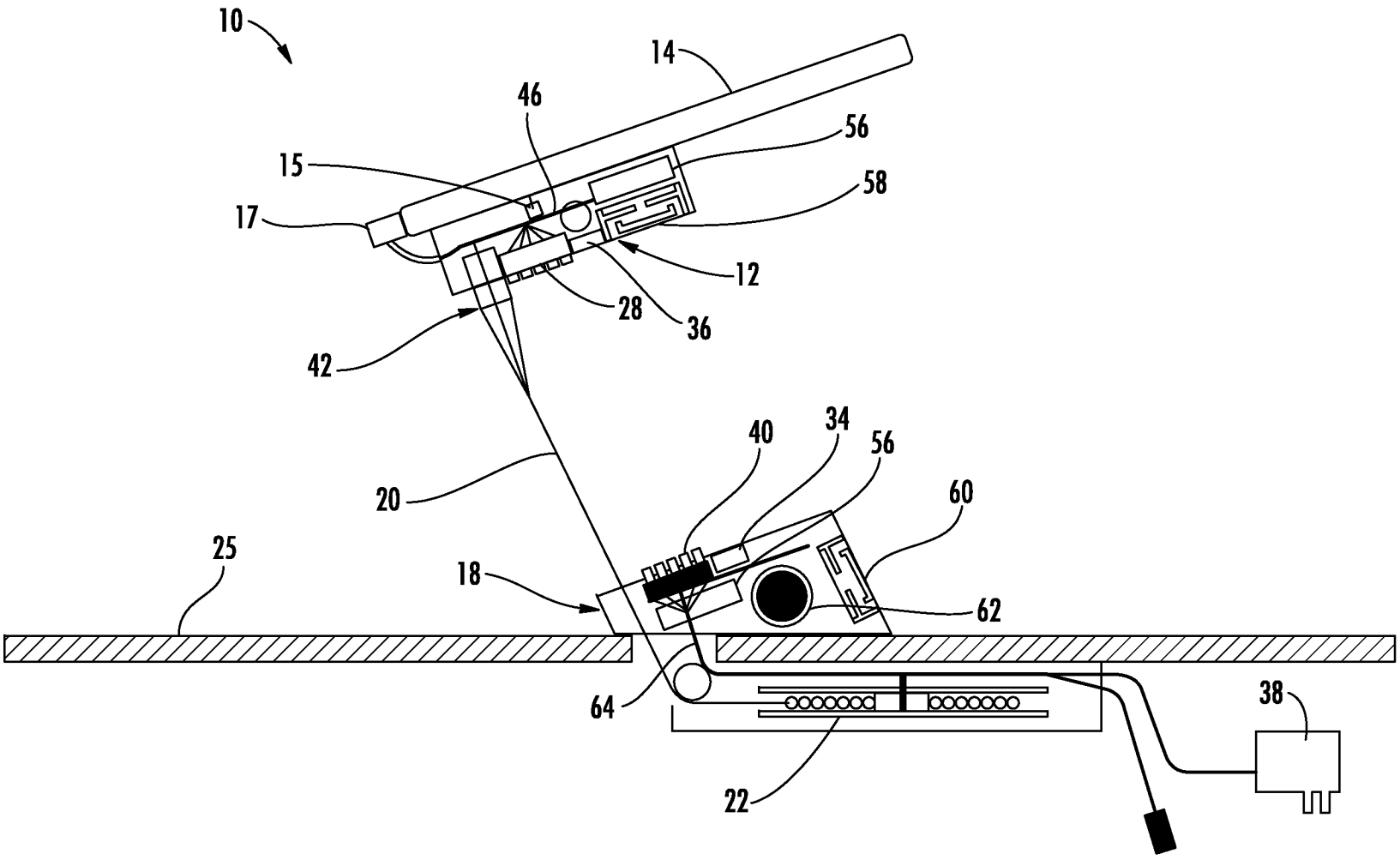
FIG. 1 illustrates a security system according to one embodiment of the present invention.
Figure 2A:
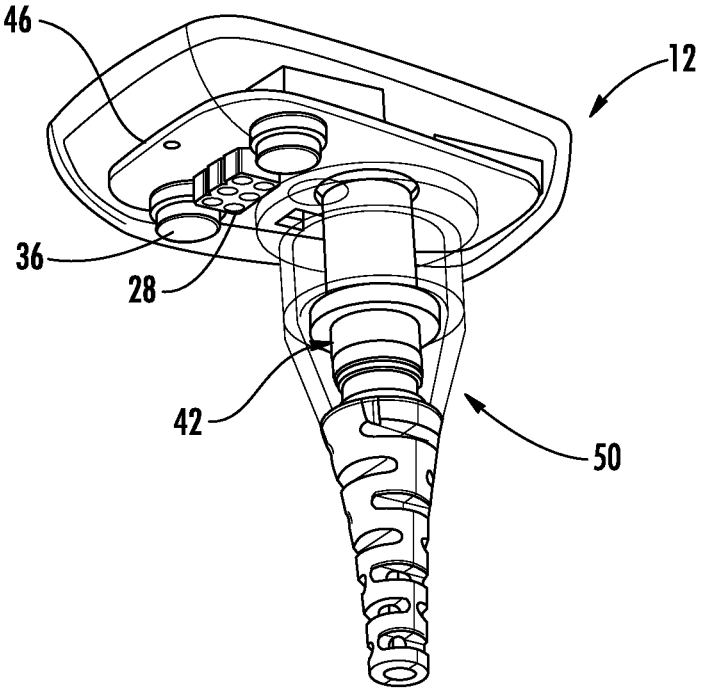
FIGS. 2A-2B illustrate a sensor according to one embodiment of the present invention.
Figure 2B:
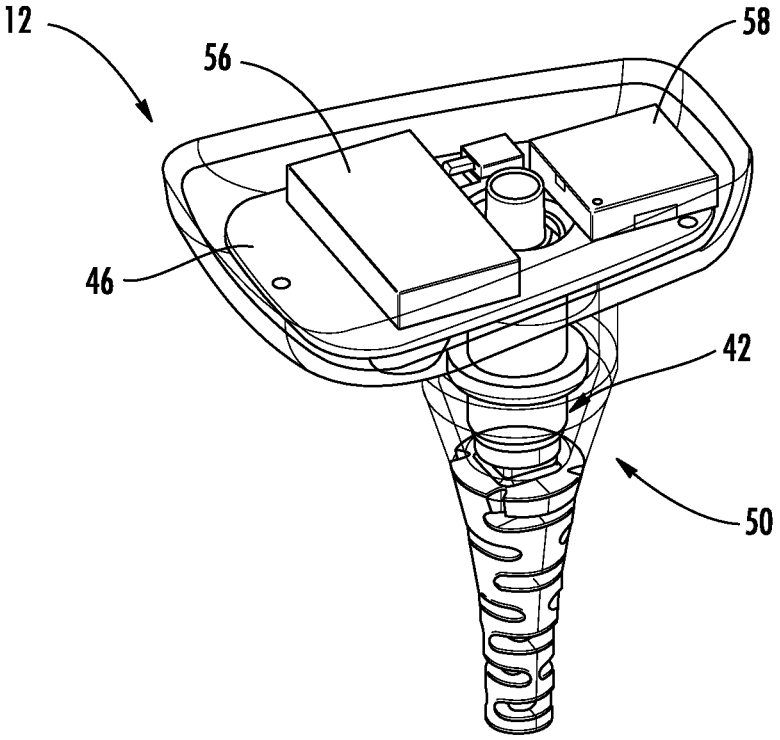
Figure 3A:
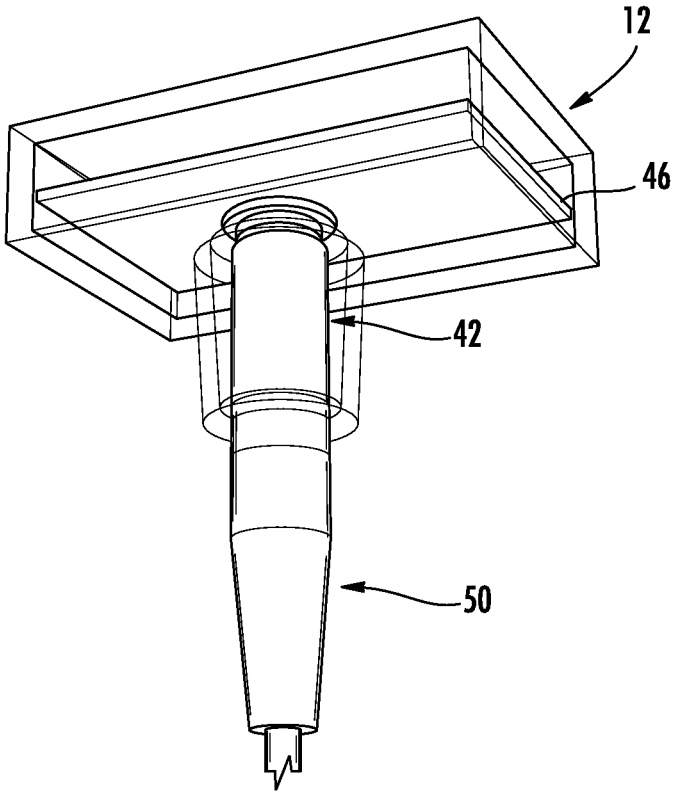
FIGS. 3A-3B illustrate a sensor according to another embodiment of the present invention.
Figure 3B:
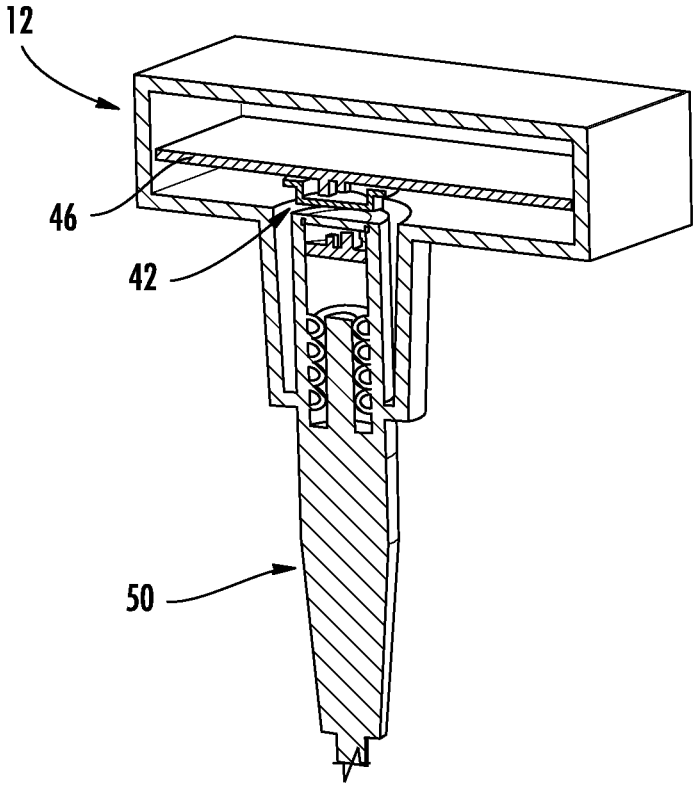

Referring to the accompanying figures wherein identical reference numerals denote the same elements throughout the various views, embodiments of security systems according to the present invention for protecting an item of merchandise against theft or unauthorized removal are disclosed. The item of merchandise may be any item, including any number of consumer electronics products (e.g. hand-held device, cellular phone, smart phone, tablet, laptop computer, etc.). The security systems described herein are operable for securing the item of merchandise against theft or authorized removal, while at the same time permitting a potential purchaser to closely examine and operate the item of merchandise in a display area. The security system permits a potential purchaser to examine and test the item of merchandise, while reducing the likelihood that the item of merchandise will be stolen or removed from the display area by an unauthorized person. The systems shown and described herein are suitable for securing an item of merchandise in a residential or commercial environment, as well as a retail environment, and furthermore, is not intended to be limited to use only as a security display device for protecting against theft and/or unauthorized removal.

According to one embodiment shown in FIG. 1, the security system 10 generally comprises a sensor 12 configured to be secured to an item of merchandise 14. The sensor 12 may be electrically connected to a connector 17 that is configured to electrically connect to an input jack of the item of merchandise 14. The security system 10 may also include a base 18 that is configured to removably support the sensor 12 and the item of merchandise 14 thereon. In some embodiments, the base 18 and the sensor 12 include one or more contacts 28, 40 for facilitating contact charging when the sensor is supported on the base. In addition, the security system 10 also includes a cable 20 that is coupled to the sensor 12 at one end and operably engaged with a recoiler 22 at an opposite end. As explained in further detail below, a sense circuit or loop defined through the cable 20 and the sensor 12 may be electrically isolated from any charging circuit used to charge the sensor 12 and/or the item of merchandise 14. As such, the sense loop may be used to detect various security events associated with the cable 20, such as the cable being cut, shorted, and/or disconnected. The charging circuit allows for charging of the item of merchandise 14 and/or a power source 56 carried by the sensor 12 and/or the base 18. The sensor 12 may also be used to detect security events associated with the sensor and/or the item of merchandise 14, such as the item of merchandise being removed from the sensor.

The sensor 12 may be secured to the item of merchandise 14 using any desired technique, such as an adhesive and/or mechanical brackets. The sensor 12 may have a variety of shapes and sizes for being secured to the item of merchandise 14. In one embodiment shown in FIG. 1, the sensor 12 may include a sensing device 15, such as a pressure or plunger switch, for detecting removal of the item of merchandise 14. In addition, the connector 17 may be configured to be removably inserted into the input jack of the item of merchandise 14. Thus, the sensor 12 and the item of merchandise 14 may be electrically connected via the connector 17. The sensor 12 may include a printed circuit board (PCB), circuitry, or the like. For example, the sensor 12 may include charging circuitry for facilitating power transfer between the base 18 and the item of merchandise 14. The connector 17 may be electrically connected to the PCB using various techniques, such as via a cable. In the illustrated embodiment, the connector 17 is mounted to and extends from the sensor 12 but could be positioned at other locations depending on the location of the input port of the item of merchandise 14.

As noted above, the sensor 12 may include one or more electrical contacts 28. In some embodiments, the sensor 12 includes a plurality of electrical contacts 28. The electrical contacts 28 may be in electrical communication with the PCB in the sensor 12 and the connector 17. Alternatively, the electrical contacts 28 may be electrically connected to only the connector 17. In some embodiments, the sensor 12 may not supply power to the item of merchandise 14 when the item is lifted from the base 18. Rather, the item of merchandise 14 may operate using its own power source when lifted from the base 18.

The base 18 may be configured to be supported by a fixed support or display surface 25, such as a counter, shelf, fixture, or the like. The base 18 may be secured to the support surface 25 using any desired technique such as an adhesive, brackets, and/or fasteners. The base 18 may include one or more magnets 34 or magnetic material, and the sensor 12 may include or more magnets 36 or magnetic material for releasably holding the sensor on the base. The magnets 34, 36 may aid in aligning the item of merchandise 14 in a desired display orientation.

The security system 10 may include a recoiler 22 and a cable 20 as discussed above. The base 18 may include an opening for receiving the cable 20. As such, the cable 20 may be extended through the opening when the sensor 12 and the item of merchandise 14 are lifted from the base, and the cable may be retracted through the opening when the sensor and the item of merchandise are returned to the base. The recoiler 22 may be spring biased in some embodiments such that the cable 20 is automatically retracted within the recoiler. The recoiler 22 may be mounted to an underside of the support surface 25 (see, e.g., FIGS. 1 and 4), although in other embodiments, the recoiler may be mounted within the base 18 (see, e.g., FIG. 5). Furthermore, the recoiler 22 may be in electrical communication with the cable 20. In this regard, the cable 20 may include one or more electrical conductors 53 extending along the length of the cable. In some cases, the cable 20 may include a pair of conductors for defining a sense loop or circuit and conducting an electrical signal. In other cases, the cable 20 may include a single conductor, such as an optical conductor for conducting an optical signal (e.g., a fiber optic cable).

As discussed above, the base 18 may include one or more electrical contacts 40. The contacts 28, 40 of the base 18 and the sensor 12 are configured to align with one another and contact one another when the sensor is supported on the base. Thus, the base 18 and the sensor 12 are in electrical communication with one another when the sensor is supported on the base. The base 18 may be electrically connected to a power source 38 which is configured to provide power to the base and/or the one or more electrical contacts 40 in the base. The base 18 may also include charging circuitry that is configured to facilitate power transfer from the external power source 38 and the electrical contacts 40. Thus, when the sensor 12 is supported on the base 18, power is able to be transferred between the contacts 28, 40 and to the sensor 12. The connector 17 is electrically connected to the sensor contacts 28 as power is delivered such that power is provided to the item of merchandise 14. Therefore, the item of merchandise 14 may be powered by power transferred thereto and may be used to charge a battery associated with the item of merchandise. In some embodiments, any voltage adaption occurs prior to being delivered to the sensor 12. Voltage adaption may be needed in order to accommodate different items of merchandise 14 that require different operating voltages. Any voltage adaption may occur prior to power being provided to the contacts 28 on the sensor 12. Thus, the sensor 12 and adapter cable 16 do not provide any voltage adaption. However, in other embodiments, the sensor 12 may include a resistor or other identifier that detects the voltage requirements of the item of merchandise 14 which provides a signal to the base 18 for adjusting the voltage as necessary before providing power to the sensor. Although the aforementioned embodiments describe that power may be transferred via contact charging, it is understood that other techniques could be used to transfer power to sensor 12 and the item of merchandise 14. For example, inductive charging functionality could be employed for transferring power.

In some cases, the base 18 and the sensor 12 may include an electrical contact that detects that the sensor is lifted off of the base. For example, the sensor 12 and base 18 may each include a contact that is configured to engage one another when the sensor is supported on the base. These contacts may not transfer power. However, the contact on the base 18 may communicate with the PCB to indicate when the sensor 12 has been lifted off of the base and to cease transferring power to the electrical contacts 28, 40. This arrangement of contacts may reduce arcing and power surges when the sensor 12 is placed back on the base 18 since power will no longer be transferred to the contacts on the base after the sensor is lifted.

It is understood that the cable 20 may be any suitable cord, tether, or the like. In addition, the cable 20 may include one or more electrical conductors for transmitting electrical, security, and/or communication signals. In addition, the cable 20 may be a single strand, multi-strand, or braided. The cable 20 may be flexible to facilitate extension and retraction relative to the recoiler 22, and in some embodiments, may be formed of a cut-resistant material. Furthermore, the cable 20 may have various cross sections, such as round or flat. In some embodiments, the security system 10 may not include a recoiler 22. Thus, the cable 20 could be a straight or coiled cable that is coupled to the sensor 12 at one end and electrically connected to a base or an alarm unit at an opposite end.

An end of cable 20 may be mechanically and optically connected to the sensor 12 and/or the base 18. Thus, the cable 20 may not be electrically connected to the sensor 12 in any way, and the conductors in the cable are electrically isolated from the power transmitted to the sensor and the item of merchandise 14. In one embodiment, the sensor 12 may define an opening for receiving an end of the cable 20. In some embodiments, an end of the cable 20 includes an optical transceiver 42 for communicating with the sensor 12 and/or the item of merchandise 14. Likewise, the sensor 12 may include an optical transceiver 42 for communicating with the optical transceiver at the end of the cable 20 (see, e.g., FIG. 5). In other embodiments, an opposite end of the cable 20 may include an optical transceiver 42, such as the end operably engaged with the base 18 or recoiler 22. For example, one or more optical transceivers 42 may be located within the base 18, or otherwise operably engaged with the base, and be configured to communicate with one another for defining a sense loop. Thus, it is understood that the optical transceiver(s) 42 may be located at any desired location.

Figure 4:
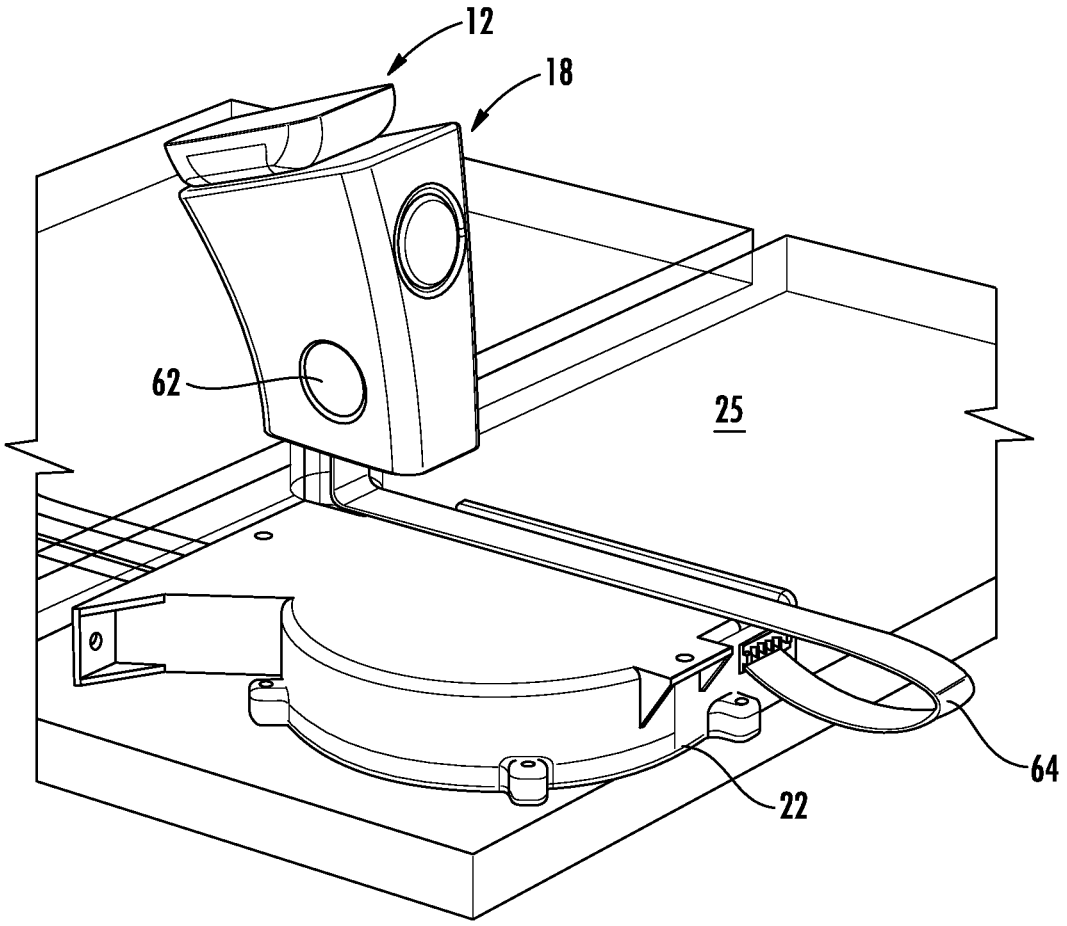
FIG. 4 illustrates a security system according to one embodiment of the present invention.
Figure 5:
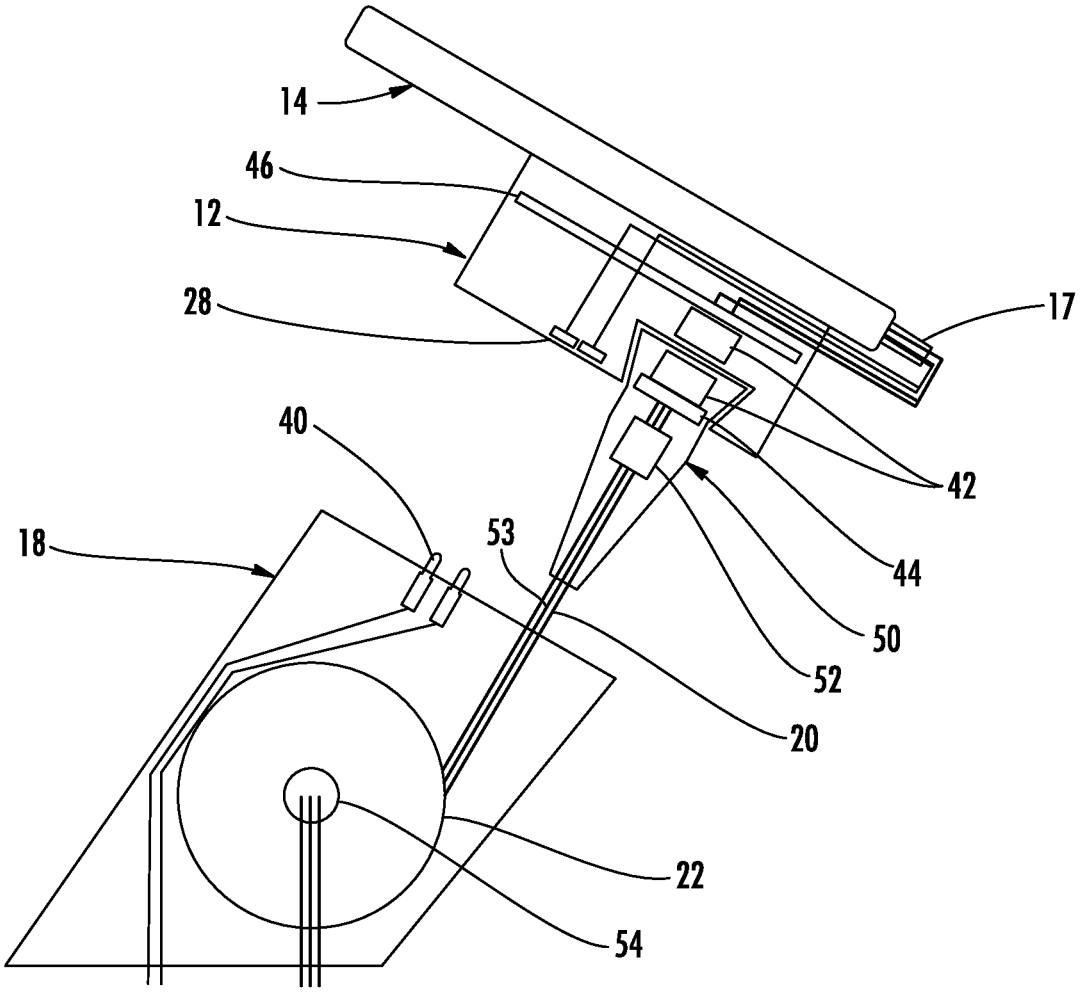
FIG. 5 illustrates a security system according to one embodiment of the present invention.

The optical transceivers 42 may be used to transmit optical signals in predetermined sequences or patterns, as well as receive optical signals and convert the optical signals into electrical signals. In addition, the optical transceivers 42 may be separated by an air gap so as to not be in physical contact with one another and such that the optical transceivers are electrically isolated from one another. The cable 20 may include one or more conductors for providing power to the optical transceiver 42, as well as sending and receiving signals to and from the optical transceiver in the sensor 12. Similarly, the sensor 12 may include a power source 56 that is configured to provide power to the sensor for interpreting signals provided by the optical transceiver 42, as well as power the optical transceiver for sending and receiving optical signals. Furthermore, the end of the cable 20 may be mechanically coupled to the sensor 12 using a variety of techniques and may be configured to rotate or swivel in some embodiments. In one example, the optical transceivers 42 may be configured to rotate relative to one another. Moreover, FIG. 5 shows that the conductors in the cable 20 may be connected to the optical transceiver 42 and a printed circuit board (PCB) or circuitry 44 at one end. Similarly, the connector 17 may include conductors connected to the optical transceiver 42 and a printed circuit board or circuitry 46 in the sensor 12. The end of the cable 20 may include a releasable connector 50 that is configured to contain the optical transceiver 42 and PCB 44. The connector 50 may also contain a crimp 52 or other like device for securing the ends of the conductors in the cable 20 together. The connector 50 may be configured to mechanically engage a cooperating connector on the sensor 12. FIG. 5 further shows that an opposite end of the cable 20 may be electrically connected to a slip ring 54 for allowing electrical and other signals to be communicated between the conductors in the cable and any conductors electrically connected to the recoiler 22. Moreover, FIGS. 1 and 4 show that in the case where the charging circuit and sense loop are separate and electrically isolated from another, a cable 64 may be used to electrically connect the contacts 40 and the input power source 38 along with any other data connections.

The optical transceivers 42 may be used to define a sense loop and detect various security events, such as when the cable 20 is cut or removed from the sensor 12 and/or the connector 17 is removed from item of merchandise 14 in an unauthorized manner. It is understood that various types of sensing techniques may be used for detecting when the cable 20 is attached or detached from the sensor 12 and/or item of merchandise 14, as well as when the connector 17 is removed from the item of merchandise. For example, the optical transceiver at the end of the cable 20 may communicate an optical signal to the optical transceiver in the sensor 12 where the sensor can determine that the item of merchandise 14 and the cable 20 are secure. The optical transceiver 42 in the sensor 12 may then communicate an optical signal to the optical transceiver 42 at the end of the cable 20 to indicate that the item of merchandise 14 is secure. The optical signals may be coded in a particular manner that is recognizable and/or expected for determining whether a security event has occurred. Should the optical signals be interrupted or an unexpected optical signal is received, the base 18 or other alarm unit may detect the interruption and generate an alarm signal. For example, the base 18 or other alarm unit may be configured to generate an audible and/or a visible alarm. For example, FIG. 1 shows that the base 18 may include an alarm 60, such as a piezoelectric device, for generating an audible alarm. The sensor 12 may likewise include an alarm 58 for generating an audible and/or a visible alarm. The base 18 may be configured to be armed and/or disarmed via a key, such as a wireless key. For instance, FIG. 1 shows that the base 18 may include a port 62 for facilitating communication with a key.

Figure 6:
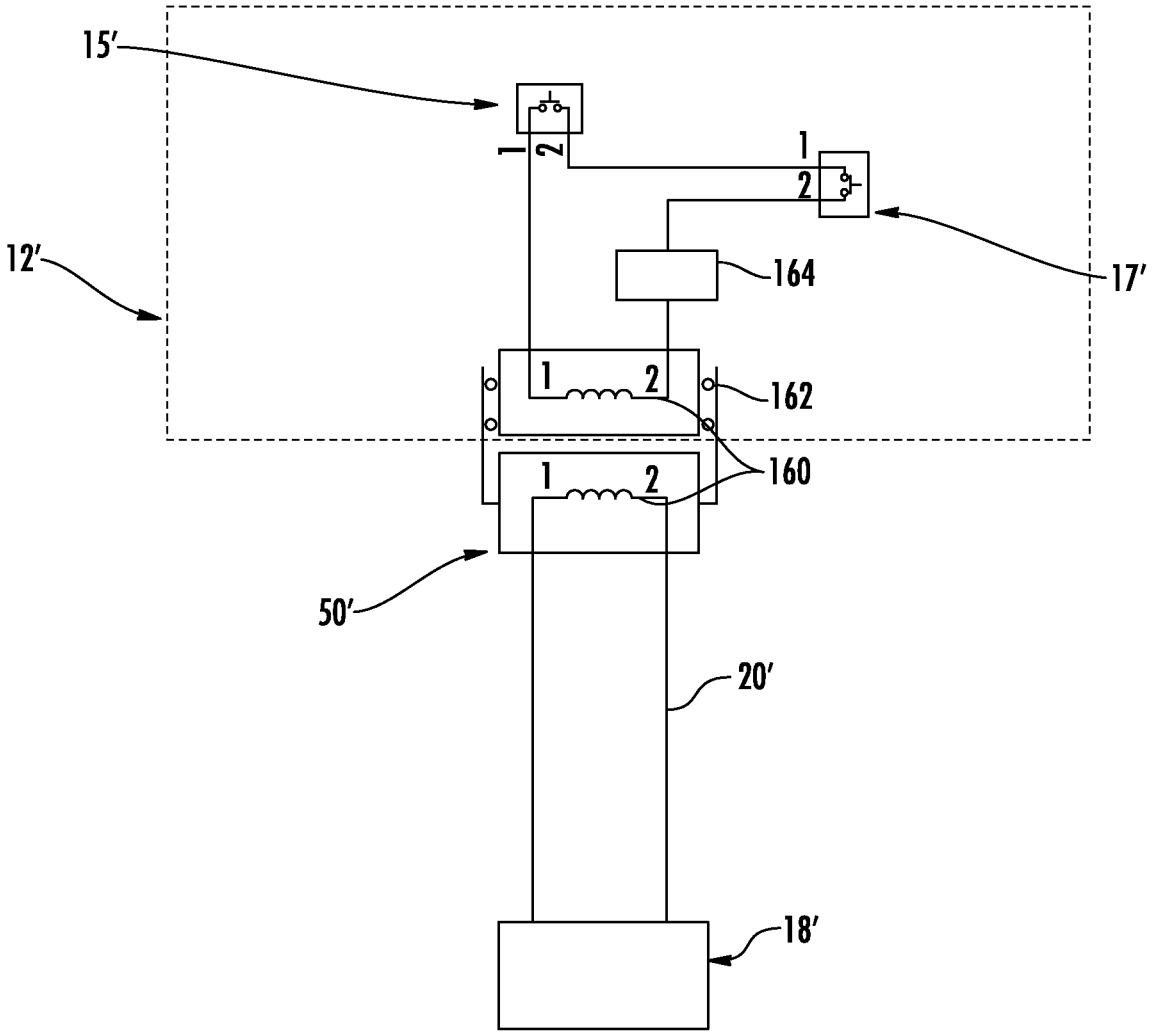
FIG. 6 illustrates a security system according to another embodiment of the present invention.

According to an embodiment shown in FIG. 6, inductors 160 may be utilized for detecting a security event. In this embodiment, an inductor 160 located at the end of the cable 20' or in the connector 50' and an inductor in the sensor 12' may be configured to communicate with one another. The inductors 160 may be configured to swivel relative to one another (e.g., via rotatable bearings 162) and may each comprise an inductive coil. The base or an alarm unit 18' may include an NFC reader chip, and the sensor 12' may include an NFC chip 164 that is connected in series with a sense loop in the connector 17'. The sense loop may also include a sensing device 15', such as a pressure or plunger switch, for detecting the presence of the item of merchandise 14. When the sense loop is closed, the NFC chip 164 will be visible to the NFC reader to the base or alarm unit 18'. If the sense loop is interrupted, such as when any of the security circuits are opened, or the cable 20 is cut, the NFC chip 164 will no longer be seen, and the base or alarm unit 18' will be configured to generate an audible and/or a visible alarm.

Figure 7:
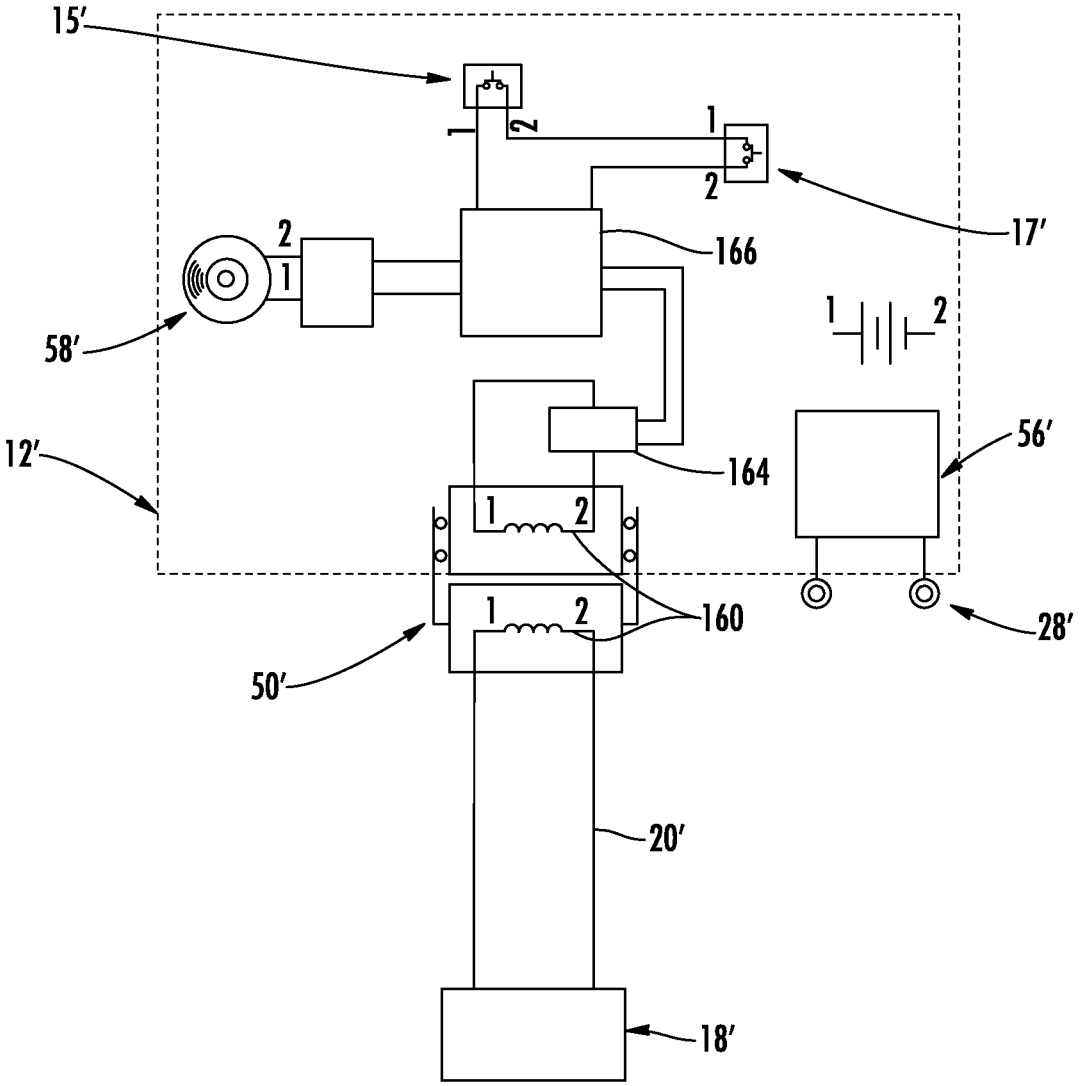
FIG. 7 illustrates a security system according to an embodiment of the present invention.
Figure 8:
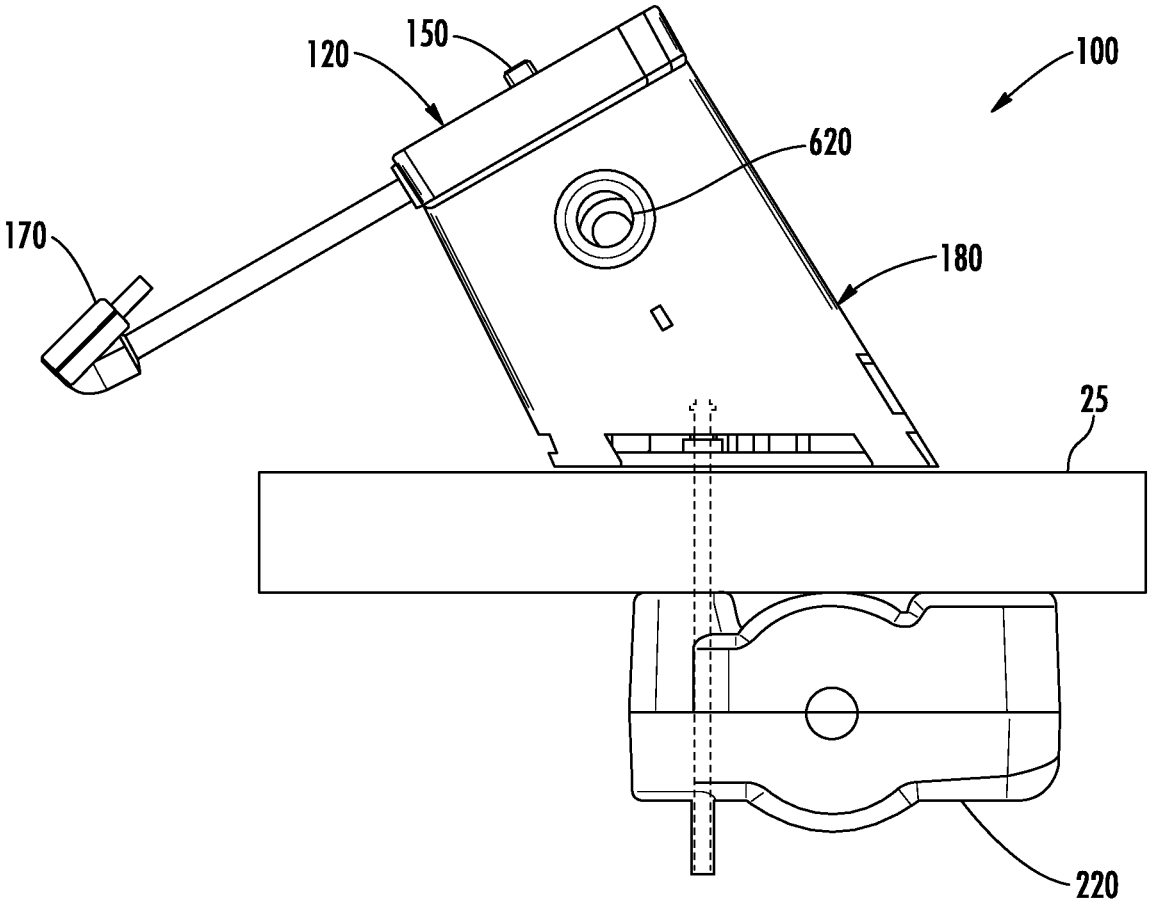
FIG. 8 illustrates a security system according to an embodiment of the present invention.
Figure 9:
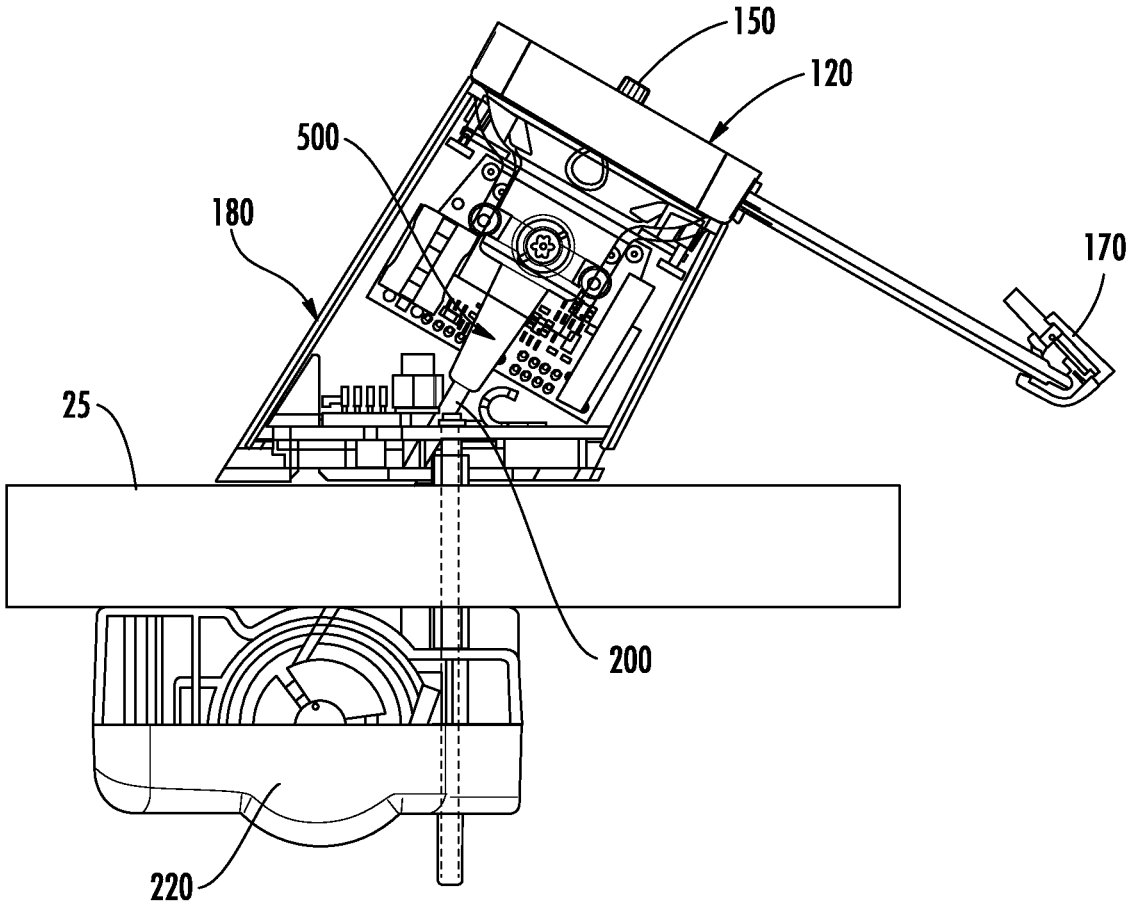
FIG. 9 is a side view of the security system shown in FIG. 8 (with a portion of the base and recoiler being transparent for purposes of illustration).
Figure 10:
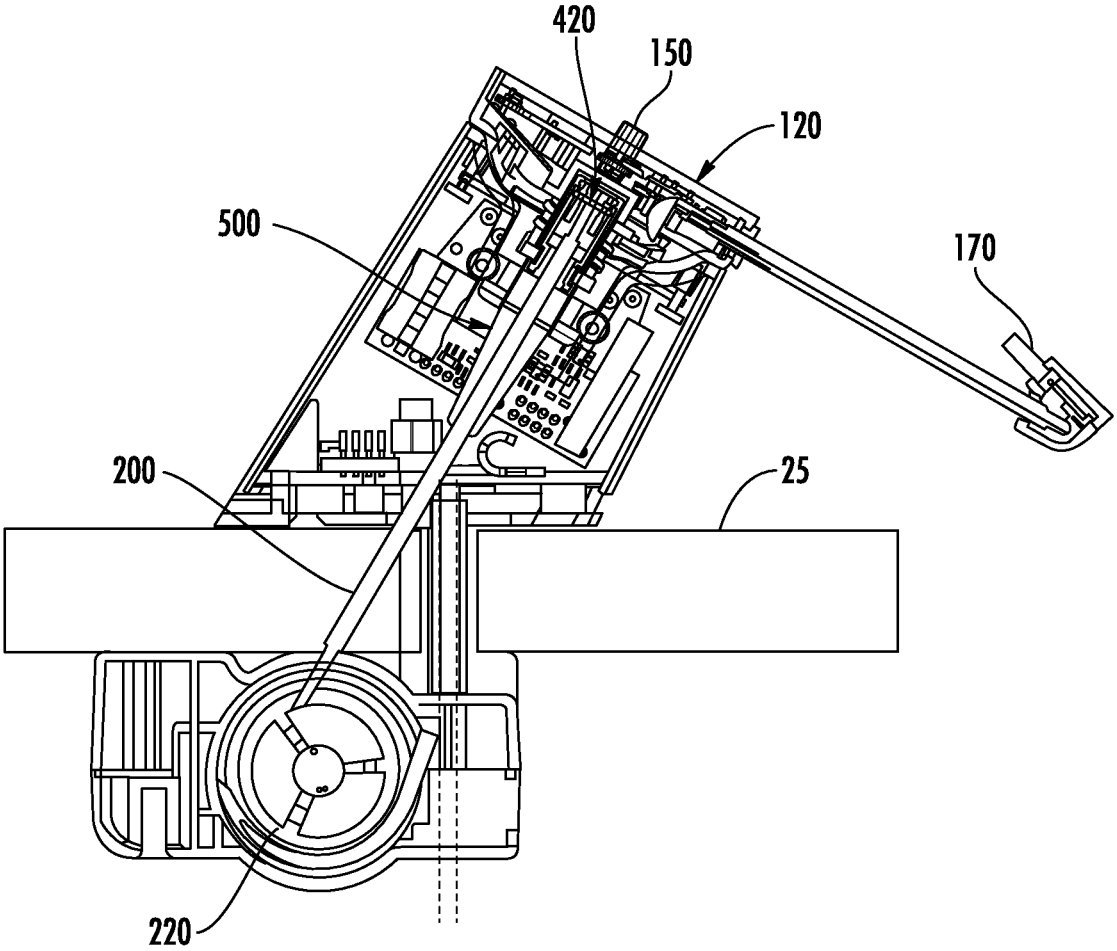
FIG. 10 is a cross-sectional view of the security system shown in FIG. 8.

FIG. 7 shows another embodiment where the sensor 12' includes an NFC chip 164. In this example, the sensor 12' also includes a microcontroller 166 that is configured to write various information on the NFC chip depending on the status of the sensor 12' (e.g., armed, alarming, or disarmed), and the base or alarm unit 18' may be configured to read the information. If the sense loop is interrupted, such as when any of the security circuits are opened, the microcontroller 166 may either disconnect the NFC chip 164 from the circuit, or write a particular packet of data to the NFC chip, which the base or alarm unit 18' will recognize and then alarm. If the cable 20' is cut or disconnected, the base or alarm unit 18' will no longer "see" the NFC chip 164 and will alarm. The sensor 12' may have contacts 28' (e.g., pogo-pins) for receiving power, which may be used to charge a power source 56' for powering the electronics in the sensor 12'. Moreover, the sensor 12' may include an alarm 58', such as a piezoelectric device, for generating an audible alarm.

In another embodiment, an end of the cable 20 may include a sound generating device (e.g., a piezoelectric device) that is configured to communicate sound from the sensor 12 to the base 18. The sound generating device could be a speaker or like device configured to generate sound and as a result, vibration, along the cable. The base 18 may likewise include a sound generating device for generating sound along the cable 20 in an opposite direction towards the sensor 12. The sound generating devices may be configured to operate at a "tone" that is outside the human audio frequency band. The sound generating device may be located within the connector 50 and may be purely mechanical in some cases. The connector 50 may include a crimp 52 that is configured to rotate on the sound generating device. The end of the cable 20 opposite the connector 50 could include a similar crimp and swivel connection with the sound generating device. In some cases, the sound generating device in the base 18 is configured to detect vibrations transmitted from the sound generating device in the sensor 12. The base 18 may include monitoring circuitry configured to detect when the vibrations cease, which may be indicative of a security event. The monitoring circuitry could also be configured to sense a particular signal format of vibrations. The monitoring circuitry could be configured to filter other sounds/vibrations so that only the desired sound/vibration is detected. In some embodiments, the sound generating devices may transmit sound periodically and towards one another. Thus, the sound generating devices may be used to determine if the cable 20 has been cut or disconnected. In some instances, the base 18 could send a high energy signal up to the sensor 12 via the cable 20, which the sensor could "energy harvest" and save the power in a capacitor or battery, so that the sensor always has power to send a "reply" to the base, at a lower power, but the base may have an amplifier to amplify the signal. Another option is to use an "echo" concept, by sending a signal up the cable 20, and use the crimp 52 at the end of the cable 20 to bounce (echo) some of the signal back to the base 18. The monitoring circuitry may monitor a sense loop and stop the "echo" in response to a security event.

FIGS. 8-11 show another embodiment of a security system 100. In this embodiment, the security system 100 includes a sensor 120 configured to be removably seated on the base 180. Each of the sensor 120 and the base 180 may be similar to that described above. As discussed above, the sensor 120 may include a connector 170 that is configured to electrically connect to an input jack of the item of merchandise 14. In this embodiment, the connector 170 includes a cable that is hardwired to the sensor 120. In addition, the sensor 120 may include a sensing device 150, such as a pressure or plunger switch, for detecting removal of the item of merchandise 14. The security system 100 may also include a recoiler 220 as also discussed above. In this embodiment, the recoiler 220 is located below the support surface 25, although in other embodiments, the recoiler may be mounted within the base 180 (see, e.g., FIG. 12). Moreover, the base 180 may include a port 620 configured to communicate with a key similar to that disclosed above.

Figure 11:
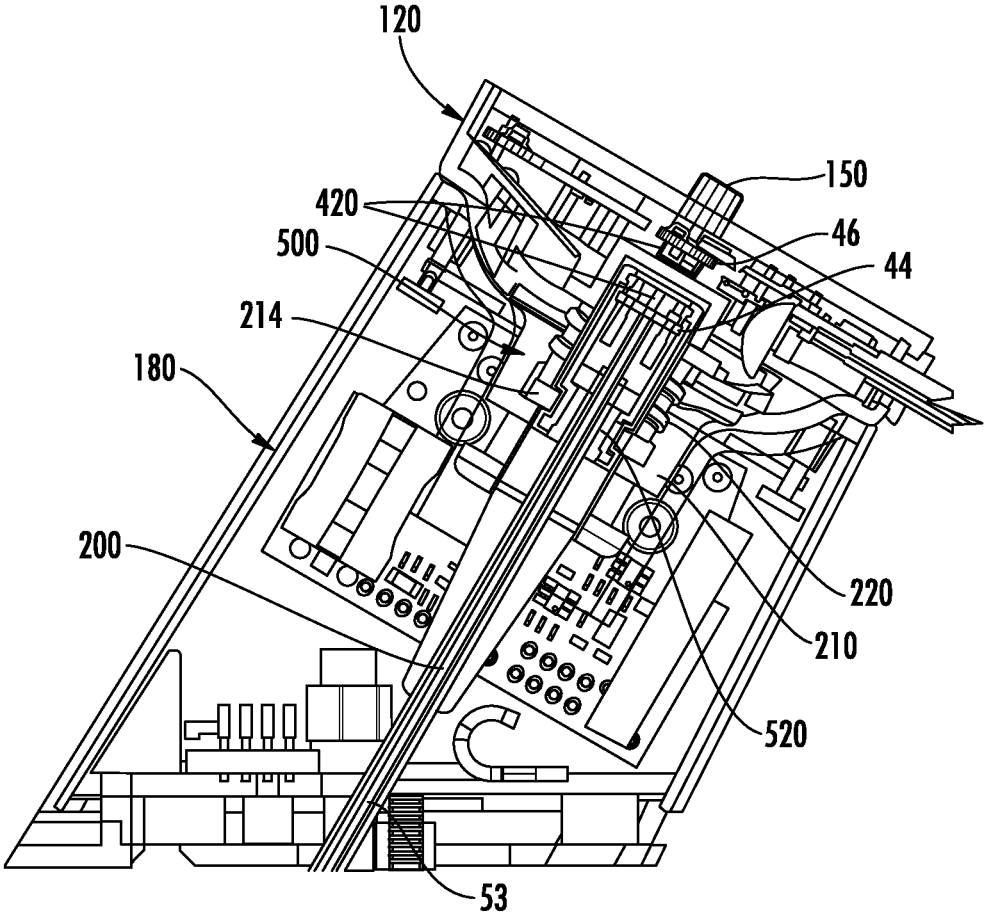
FIG. 11 is an enlarged view of the sensor and the base shown in FIG. 10.
Figure 12:
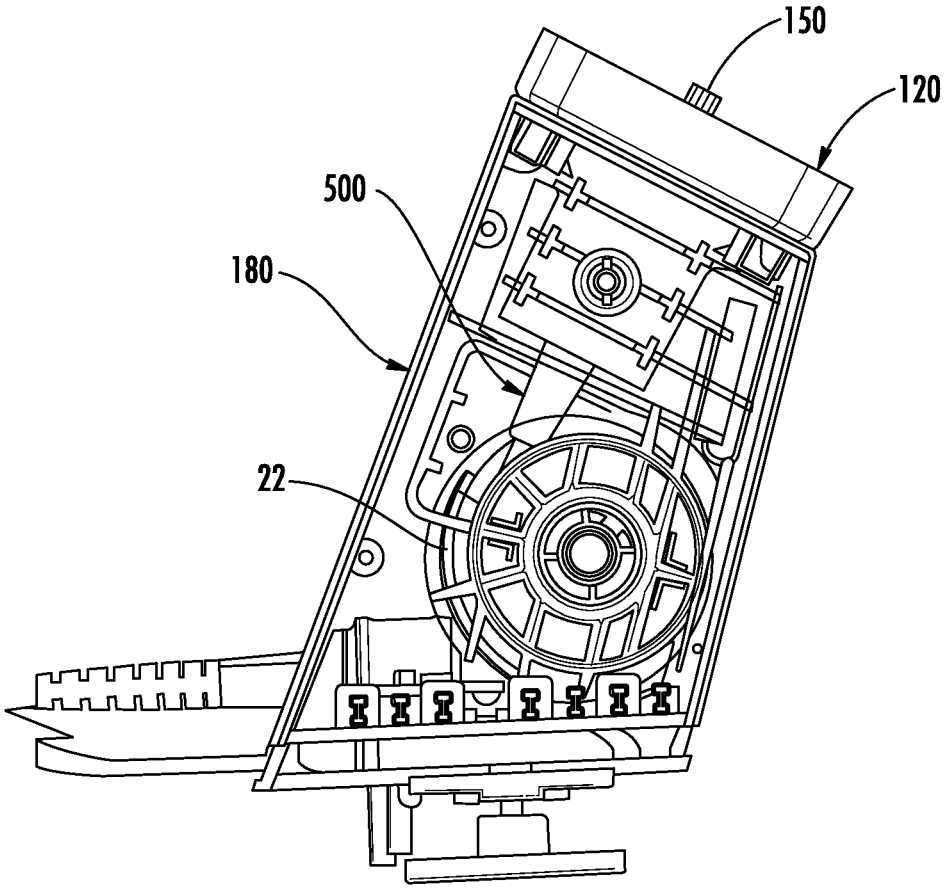
FIG. 12 illustrates a security system according to another embodiment of the present invention (with a portion of the base being transparent for purposes of illustration).

Moreover, as shown in FIG. 11, the end of the recoiler cable 200 and the sensor 120 may each include an optical transceiver 420. The end of the recoiler cable 200 may include a releasable connector 500 that is configured to connect to the sensor 120 using a variety of techniques, such as via a collar 210 that is configured to be threaded onto a corresponding connector 212 on the sensor 120. In some embodiments, a clip 214 is configured to removably secure the collar 210 to the end of the recoiler cable 200, which allows the end of the recoiler cable to be inserted through smaller openings in the support surface 25 during installation and prior to securing the collar to the recoiler cable. The end of the recoiler cable 200 including the optical transceiver 420 may be configured to rotate relative to the sensor 120. For example, the end of the recoiler cable 200 may include a crimp 520 that is configured to rotate along with the clip 214 relative to the sensor 120 within the connector 500. Advantageously, FIG. 11 shows that the end of the recoiler cable 200 and associated releasable connector 500 are able to be recessed within the housing of the sensor 120, more so than conventional connectors.

As discussed above, the optical transceivers 420 are configured to communicate with one another. In some embodiments, the optical transceivers 420 are configured to transfer data between the sensor 120 and the base 180 (and vice versa). As long as data is being sent and received by the sensor 120 and base 180, respectively, no security event occurs. Thus, in some cases, particular coded light signals may be unnecessary, although coded signals could be used in combination with data in other embodiments. Data may be communicated in any predetermined time interval to ensure that communication is maintained in the absence of a security event and detect when communication is lost when a security event occurs. Various types of data may be configured to be communicated between the sensor 120 and the base 180 via optical signals, such as, for example, the type of merchandise 14 connected to the sensor 120, the serial number of the merchandise, the manufacturer of the merchandise, whether the sensor is a USB host, USB multiplexer configuration in the sensor or the base, whether the data corresponds to the sensor or the base, power status (e.g., power is being transferred to the sensor 120 from the base 180), the voltage received by the sensor from the base, the temperature within the sensor or the base, the power source 56 status in the sensor or base (e.g., battery voltage), whether the sensor or base is alarming or armed or disarmed, the type of connector 170, and any combination thereof. The data transferred may include one or more packets of information such that various types and amounts of data may be transferred via the optical transceivers 420.

Figure 13:
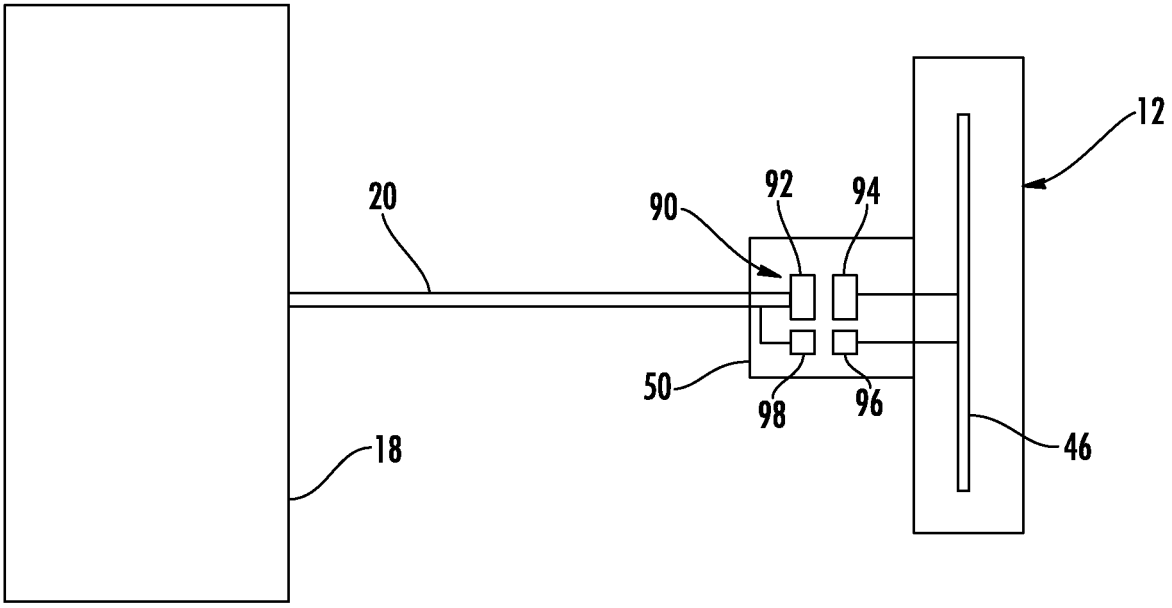
FIG. 13 illustrates a security system according to one embodiment of the present invention.

According to another embodiment, the security system includes a photovoltaic isolator 90 (see FIG. 13). For example, the photovoltaic isolator may include a light-emitting element 92 (e.g., one or more LEDs) and a light-receiving element 94 (e.g., one or more photo cells). In some cases, the light-emitting element and the light-receiving element are housed within connector 50, 500. The connector 50, 500 may be hardwired to the sensor in one embodiment, and a separate connector for disconnecting the cable 20 may be employed between the connector 50, 500 and the base 18. The light-emitting element 92 is configured to optically transfer infrared or like energy to the light-receiving element 94. The light-receiving element 94 is configured to generate power in response to receiving the infrared energy which could be used for various purposes. For instance, the light-receiving element 94 may be electrically connected to an optical coupler 96 configured to send an optical signal back to an optical coupler 98. The optical couplers 96, 98 could be housed within connector 50, 500 and/or sensor 12. The sensor 12 may include circuitry 46 that is in electrical communication with both the light-receiving element 94 and the optical coupler 96. As long as the optical couplers 96, 98 are communicating with one another, the sense loop is complete and no security event has occurred. The optical coupler 96 could use the power transferred from the light-receiving element to send an optical signal back to the optical coupler 98. As discussed above, the base 18 may be configured to detect various security events associated with interruption of the sense loop. Therefore, similar to the embodiments disclosed above, use of a photovoltaic isolator 90 allows for a sense loop to be defined between the cable 20 and the sensor 12, and the cable and sensor may be electrically isolated from any charging circuit used to charge the sensor and/or the item of merchandise 14.

Therefore, embodiments of the present invention may provide several advantages. As noted above, the sense loop and the charging circuit may be electrically isolated from one another. Because the conductor(s) in the cable 20, 200 are electrically isolated from the charging circuit and any voltage adaption may occur in the base 18, 180, the cable may also be simplified in construction in order to define a sense loop. It is also possible that a greater effective length of cable 20, 200 may be used for a similarly sized recoiler 22, 220 since a smaller diameter wire may be used. Moreover, the pull force required to extend the cable 20, 200 from the recoiler 22, 220 may also be reduced in view of larger cables (e.g., less than 1 lb). It is also possible that less "wear and tear" may take place on the cable 20, 200, sensor 12, 120, and base 18, 180 since lighter and smaller components may be used. Moreover, the optical transceivers 42, inductors, and photovoltaic isolators 90, may provide additional advantages, such as the elimination of an electrical connection, electrical conductors, and/or swivel between the cable 20, 200 and the sensor 12, 120. Thus, the size of the end of the cable 20 may be reduced, and the mechanical connection between the cable and the sensor may be more robust.

The foregoing has described one or more embodiments of security systems for securing an item of merchandise from theft or unauthorized removal. Although various embodiments of the present invention have been shown and described, it will be apparent to those skilled in the art that various modifications thereto can be made without departing from the spirit and scope of the invention. Accordingly, the foregoing description is provided for the purpose of illustration only, and not for the purpose of limitation.

That which is claimed is:

1. A security system for securing an item of merchandise, comprising:

a sensor configured to be attached to the item of merchandise, wherein the sensor comprises a printed circuit board and an optical transceiver housed within the sensor, the optical transceiver being attached to the printed circuit board;

a cable comprising a free end configured to be attached to the sensor, the free end comprising an optical transceiver, wherein the cable is not a fiber optic cable; and a base configured to removably support the sensor and the item of merchandise thereon, the base comprising an opening for receiving the cable therethrough for allowing the cable to be extended and retracted, wherein the optical transceiver of the cable and the optical transceiver of the sensor are configured to communicate optical signals with one another when the cable is attached to the sensor, wherein the sensor or the base is configured to generate an alarm signal in response to disconnection of the cable from the sensor or cutting of the cable based on an interruption of the communication of optical signals.

2. The security system of claim 1, wherein the cable comprises a plurality of electrical conductors for providing power to the optical transceiver of the cable, and wherein the plurality of electrical conductors are configured to communicate signals to and from the optical transceiver of the sensor.

3. The security system of claim 1, further comprising a releasable connector configured to attach the free end of the cable to the sensor and to receive the optical transceiver of the cable.

4. The security system of claim 3, wherein the optical transceiver of the cable is configured to rotate within the releasable connector.

5. The security system of claim 3, wherein the releasable connector is configured to threadably engage the sensor.

6. The security system of claim 3, wherein the releasable connector comprises a threaded collar having threads for engaging corresponding threads defined by the sensor.

7. The security system of claim 6, wherein the threads of the threaded collar surround the optical transceiver of the cable when the threaded collar is attached to the sensor.

8. The security system of claim 7, wherein the threads of the sensor surround the optical transceiver of the cable when the threaded collar is attached to the sensor.

9. The security system of claim 6, further comprising a clip configured to removably secure the threaded collar to the end of the cable.

10. The security system of claim 9, wherein the threaded collar is configured to receive the clip therein.

11. The security system of claim 3, wherein the opening of the base is configured to receive the releasable connector therein when the sensor is seated on the base.

12. The security system of claim 1, wherein the sensor comprises a connector configured to electrically connect the sensor to the item of merchandise, wherein the optical transceiver of the cable and the optical transceiver of the sensor are configured to communicate with one another to determine if the connector has been removed from the item of merchandise.

13. The security system of claim 1, wherein the optical transceiver of the cable and the optical transceiver of the sensor are configured to transmit data between one another.

14. The security system of claim 13, wherein the sensor or the base comprises an alarm configured to generate the alarm signal in response to the failure of the optical transceiver of the sensor or the optical transceiver of the cable to receive the data.

15. The security system of claim 1, wherein the sensor comprises a power source for providing power to the optical transceiver of the sensor, and wherein the power source is configured to provide power to the sensor for interpreting signals provided by the optical transceiver of the sensor and to provide power to the optical transceiver of the sensor.

16. The security system of claim 1, wherein the sensor comprises an upper surface configured to attach to the item of merchandise and a rear surface configured to connect to the releasable connector, wherein the rear surface defines a recess containing the optical transceiver of the sensor.

17. The security system of claim 16, wherein the recess is configured to receive the optical transceiver of the cable.

18. The security system of claim 16, wherein the sensor further comprises a plunger or pressure switch on the upper surface for detecting removal of the item of merchandise.

19. The security system of claim 1, further comprising a recoiler electrically connected to the cable and configured to retract the cable when the sensor is returned to the base.

20. The security system of claim 19, wherein the cable is directly attached to the base via the recoiler housed within the base.

21. The security system of claim 1, wherein the base is configured to be attached to a support surface, and wherein the recoiler is configured to be mounted to an underside of the support surface.

22. The security system of claim 1, wherein the optical transceiver of the sensor and the optical transceiver of the cable do not communicate using coded signals.

23. The security system of claim 1, wherein the optical transceiver of the cable and the optical transceiver of the sensor are configured to communicate with one another to detect removal of the item of merchandise from the sensor.

24. The security system of claim 1, wherein the optical transceiver of the cable and the optical transceiver of the sensor are separated by an air gap when the free end of the cable is attached to the sensor.

25. The security system of claim 1, wherein the base is configured to detect the interruption of the communication of optical signals.

26. A security system for securing an item of merchandise, comprising:

a sensor configured to be attached to the item of merchandise, wherein the sensor comprises an optical transceiver housed therein;

a cable comprising a free end configured to be attached to the sensor, the free end comprising an optical transceiver, wherein the cable is not a fiber optic cable; and a base configured to removably support the sensor and the item of merchandise thereon, the base comprising an opening for receiving the cable therethrough for allowing the cable to be extended and retracted, wherein the optical transceiver of the cable and the optical transceiver of the sensor are configured to communicate optical signals with one another when the cable is attached to the sensor, wherein the sensor or the base is configured to generate an alarm signal in response to disconnection of the cable from the sensor or cutting of the cable based on an interruption of the communication of optical signals.

27. The security system of claim 26, wherein the cable comprises a plurality of electrical conductors for providing power to the optical transceiver of the cable, and wherein the plurality of electrical conductors are configured to communicate signals to and from the optical transceiver of the sensor.

28. The security system of claim 26, further comprising a releasable connector configured to attach the free end of the cable to the sensor and to receive the optical transceiver of the cable.

29. The security system of claim 28, wherein the optical transceiver of the cable is configured to rotate within the releasable connector.

30. The security system of claim 28, wherein the releasable connector is configured to threadably engage the sensor.

31. The security system of claim 28, wherein the releasable connector comprises a threaded collar having threads for engaging corresponding threads defined by the sensor.

32. The security system of claim 31, wherein the threads of the threaded collar surround the optical transceiver of the cable when the threaded collar is attached to the sensor.

33. The security system of claim 32, wherein the threads of the sensor surround the optical transceiver of the cable when the threaded collar is attached to the sensor.

34. The security system of claim 31, further comprising a clip configured to removably secure the threaded collar to the end of the cable.

35. The security system of claim 34, wherein the threaded collar is configured to receive the clip therein.

36. The security system of claim 28, wherein the opening of the base is configured to receive the releasable connector therein when the sensor is seated on the base.

37. The security system of claim 26, wherein the sensor comprises a connector configured to electrically connect the sensor to the item of merchandise, wherein the optical transceiver of the cable and the optical transceiver of the sensor are configured to communicate with one another to determine if the connector has been removed from the item of merchandise.

38. The security system of claim 26, wherein the optical transceiver of the cable and the optical transceiver of the sensor are configured to transmit data between one another.

39. The security system of claim 38, wherein the sensor or the base comprises an alarm configured to generate the alarm signal in response to the failure of the optical transceiver of the sensor or the optical transceiver of the cable to receive the data.

40. The security system of claim 26, wherein the sensor comprises a power source for providing power to the optical transceiver of the sensor, and wherein the power source is configured to provide power to the sensor for interpreting signals provided by the optical transceiver of the sensor and to provide power to the optical transceiver of the sensor.

41. The security system of claim 26, wherein the sensor comprises an upper surface configured to attach to the item of merchandise and a rear surface configured to connect to the releasable connector, wherein the rear surface defines a recess containing the optical transceiver of the sensor.

42. The security system of claim 41, wherein the recess is configured to receive the optical transceiver of the cable.

43. The security system of claim 41, wherein the sensor further comprises a plunger or pressure switch on the upper surface for detecting removal of the item of merchandise.

44. The security system of claim 26, further comprising a recoiler electrically connected to the cable and configured to retract the cable when the sensor is returned to the base.

45. The security system of claim 44, wherein the cable is directly attached to the base via the recoiler housed within the base.

46. The security system of claim 26, wherein the base is configured to be attached to a support surface, and wherein the recoiler is configured to be mounted to an underside of the support surface.

47. The security system of claim 26, wherein the optical transceiver of the sensor and the optical transceiver of the cable do not communicate using coded signals.

48. The security system of claim 26, wherein the optical transceiver of the cable and the optical transceiver of the sensor are configured to communicate with one another to detect removal of the item of merchandise from the sensor.

49. The security system of claim 26, wherein the optical transceiver of the cable and the optical transceiver of the sensor are separated by an air gap when the free end of the cable is attached to the sensor.

50. The security system of claim 26, wherein the base is configured to detect the interruption of the communication of optical signals.

51. A method for securing an item of merchandise, comprising:

attaching a sensor to an item of merchandise, wherein the sensor comprises an optical transceiver housed therein; and attaching a free end of a cable to the sensor, wherein the cable is not a fiber optic cable, the free end of the cable comprising an optical transceiver; and positioning the sensor and the item of merchandise on the base, the sensor and the item of merchandise configured to be lifted from the base and returned to the base while the cable is attached to the sensor, wherein the optical transceiver of the cable and the optical transceiver of the sensor are configured to communicate optical signals with one another when the cable is attached to the sensor, wherein the sensor or the base is configured to generate an alarm signal in response to disconnection of the cable from the sensor or cutting of the cable based on an interruption of the communication of optical signals.

* * * * *